US006242171B1

(12) United States Patent
Gourlaouen

(10) Patent No.: US 6,242,171 B1
(45) Date of Patent: Jun. 5, 2001

(54) TABULAR GRAIN SILVER HALIDE EMULSION AND METHOD OF PREPARATION

(75) Inventor: Luc R. Gourlaouen, Givry (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/458,555

(22) Filed: Dec. 9, 1999

(30) Foreign Application Priority Data

Dec. 24, 1998 (FR) ..... 98 16593

(51) Int. Cl.[7] ..... G03C 1/005; G03C 1/494

(52) U.S. Cl. ..... 430/567; 430/569; 430/570; 430/599; 430/603; 430/604; 430/605

(58) Field of Search ..... 430/567, 599, 430/603, 604, 605, 570, 569

(56) References Cited

U.S. PATENT DOCUMENTS 4,520,098 * 5/1985 Dickerson ..... 430/570
4,812,390 * 3/1989 Giannesi ..... 430/567
5,176,990 1/1993 Kim .
5,514,517 5/1996 Waki .
5,726,006 * 3/1998 Gourlaouen et al. ..... 430/567
5,879,873 * 3/1999 Gourlaouen et al. ..... 430/569
6,080,536 * 6/2000 Elst et al. ..... 430/567

FOREIGN PATENT DOCUMENTS 645 668 3/1995 (EP) .

* cited by examiner

*Primary Examiner*—Geraldine Letscher
(74) *Attorney, Agent, or Firm*—Andrew J. Anderson

(57) ABSTRACT

This invention concerns tabular photographic emulsions and their preparation. According to the invention, high bromide tabular emulsion is precipitated and then a non-sensitized fine grain emulsion comprising grains exhibiting {100} crystal faces is added, before sensitization. The resulting emulsion exhibits improved speed/fog performance.

12 Claims, 1 Drawing Sheet

TABULAR GRAIN SILVER HALIDE EMULSION AND METHOD OF PREPARATION

FIELD OF THE INVENTION

The invention relates to sliver halide photography. More specifically, the invention relates to a method for the preparation of a high bromide tabular grain emulsion and to the emulsion prepared by the method.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area, and preferably more than 70 percent of total grain projected area.

The term "high bromide" in referring to grains and emulsions indicates that bromide is present in a concentration greater than 50 mole percent, based on total silver.

In referring to silver halide grains and emulsions containing two or more halides, the halides are named in order of descending concentrations.

The term "fine grain" indicates a grain having an edge length of less than about 0.5 micrometer.

The term "coefficient of variation" or "COV" is defined as 100 times the standard deviation (sigma) of grain ECD divided by average grain ECD.

Pluronic 31R1 is the BASF trademark for $$HO—[CH(CH_3)CH_2O]_x—(CH_2CH_2O)_y—[CH_2(CH_3)CHO]_{x'}—H$$

where x=25, x'=25 and y=7.

*Research Disclosure* is published by Kenneth Mason Publications, Ltd., Dudley House, 12 North St., Emsworth, Hampshire P010 7DQ, England.

BACKGROUND OF THE INVENTION

The ability to differentiate between an exposed area and an unexposed area of a film or paper is essential in a photographic product. The exposed photographic product is developed by a chemical developer that affords a high amplification by the production of metallic silver resulting from the catalytic action of latent image centers formed by the exposure. The silver formed makes up the final image in black-and-white products. In color photographic products, the oxidized developer resulting from the reduction of the silver halide to metallic silver reacts with couplers to form a dye image. In a negative-working emulsion, the ability of the emulsion to differentiate an exposed area and an unexposed area of a photographic element depends on the possibility that this emulsion silver halide is reduced in exposed areas only while there is no unwanted formation of metallic silver in unexposed areas not meant to be developed during processing. However, metallic silver can be formed in unwanted areas as a result of oversensitization e.g. with gold and sulfur, or of the presence of traces of metals such as Fe, Ni, Pb, Sn, Cu, or Ni. The result of this is a density build up (or fog) in Dmin areas.

Many methods have been proposed to minimize the increase of Dmin in negative-type emulsion coatings. These methods include adding, at various stages in the preparation of a photographic emulsion, stabilizers, antifoggants, anti-kinking agents, latent image stabilizers, prior to coating. Examples of addenda for this purpose are disclosed in Research Disclosure, September 1994, publication No 36544, Chapter VII, page 515.

It should be noted that the differentiation between an exposed area and an unexposed area on a film or paper is not the sole criterion used to evaluate the performance of a photographic material. The photographic industry seeks to improve the speed of the emulsions without increased fogging, or even with decreased fogging, without incurring a granularity penalty.

It is, however, well-known that increasing the speed of a photographic emulsion can favor fogging and result in an increase of granularity.

Currently, most photographic materials are based on emulsions containing silver halide grains of tabular form, because it is recognized that the use of such tabular grains provides high performance silver halide photography in terms of advantages such as for instance covering power, developability, separation of native and spectral sensitivities, or speed/granularity relation. However, it is still desirable to increase the speed of the emulsion without at the same time incurring a fog and granularity penalty.

SUMMARY OF THE INVENTION

The present invention provides a method of preparing novel emulsions that exhibit an improved relationship between imaging speed and minimum density (fog).

In one aspect this invention is directed to a method of preparing a silver halide tabular grain emulsion comprising (a) providing an emulsion in which silver halide tabular grains containing greater than 50 mole percent bromide, based on silver, account for greater than 50 percent of total grain projected area, (b) adding to the emulsion of step (a) emulsion containing non-sensitized silver halide grains which (i) contain greater than 80 mole percent bromide, based on silver, (ii) exhibit {100} crystal faces, and (iii) exhibit a mean grain edge length of less than about 0.5 micrometers, and (c) chemically sensitizing the emulsion resulting from step (b).

In another aspect, this invention is directed to a novel emulsion prepared by the method of the invention.

DESCRIPTION OF THE INVENTION

Figure 1:
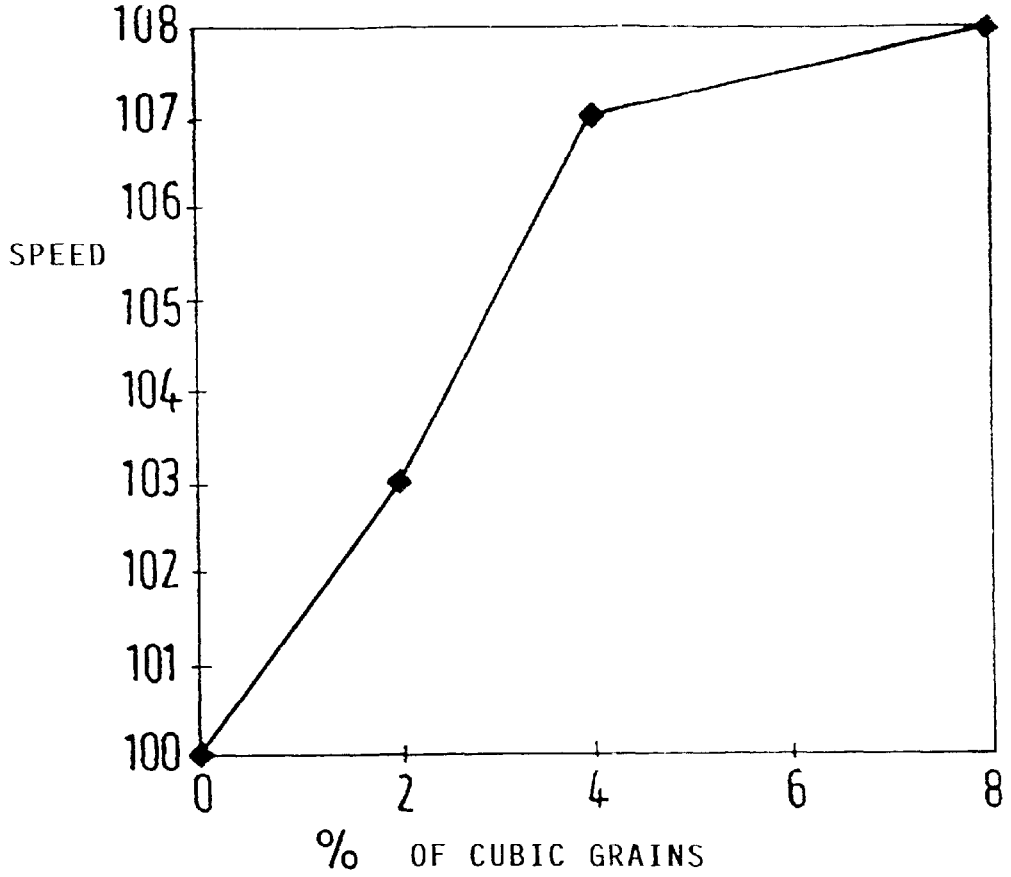
FIG. 1 is a plot of the speed variation versus the addition of various percentages of non-sensitized silver halide fine cubic grains.

The present invention is directed to a method of preparing high bromide tabular grain emulsions that exhibit an improved relationship of imaging speed to minimum density (fog). Both the method of preparing the emulsions and the emulsions prepared are novel.

The method for preparing the emulsions begins with the step of providing a high bromide silver halide tabular grain emulsion. Thereafter, a non-sensitized fine grain emulsion comprised of greater than 80 mole percent bromide, based on silver, is introduced into the high bromide tabular grain emulsion. The emulsion resulting is then chemically sensitized.

In this application, a 'high bromide content' means that the grains contain at least 50 mole percent bromide, based on silver. Preferably, the grains contain at least 80 mole percent bromide. More preferably, the grains contain at least 90 mole percent bromide, based on silver. Iodide can be present in levels up to saturation. Preferably, iodide is limited to less than 20 mole percent of iodide. Optimally, iodide is less than 10 mole percent, based on silver. In a preferred embodiment, the emulsion contains less than 5 mole percent of iodide, based on silver.

The tabular grain emulsions that are useful according to the invention can also contain chloride. Preferably, chloride is less than 5 mole percent based on silver.

Preferably, the mean equivalent circular diameter is from 0.8 to 10 micrometers (preferably less than 5 micrometers), and the tabular grains account for at least 70% of the total projected area of the grains.

The tabular grain emulsions have been described for example in Research Disclosure, Sepember 1996, No. 38957, Section I.B. (referred to below as *Research Disclosure*). The grains can have {100} and/or {111} major crystal faces.

The tabular grain emulsions that are useful according to the invention are prepared by precipitation of a silver salt and one or more halides in the presence of an aqueous hydrophilic colloid. The methods of precipitation of these grains are known, and for example are described in *Research Disclosure* Section I.C.

The tabular grain emulsions that are useful according to the invention contain tabular grains as described above, dispersed in a water-permeable hydrophilic colloid such as gelatin, gelatin derivatives, such as phthalylated gelatin, albumin, polyvinyl alcohol, polyvinyl polymers, etc.

The tabular grain emulsions that are useful according to the invention can contain dopants, usually in small amounts, such as rhodium, ruthenium, indium, osmium or iridium ions, etc. (see Section I-D3 of *Research Disclosure*). These dopants are usually incorporated during the precipitation of the emulsion.

According to the invention, the non-sensitized silver halide fine grain emulsions containing {100} crystal faces grains that are added to the high bromide tabular grain emulsions contain advantageously at least 80 (preferably at least 90 and optimally at least 95) mole percent of bromide, based on silver, and less than 20 (preferably less than 10 and optimally less than 5) mole percent of iodide. These fine grains can have, e.g., a cubic shape, a cubical shape with rounded edges and/or corners, or can have a tetradecahedral shape, with cubic grains being preferred.

These emulsions with such fine grains are prepared using conventional simultaneous or alternate double jet or single jet precipitation methods described in *Research Disclosure*, Section I.C.

In a specific embodiment of the invention, the mean length of the edge of the main {100} faces of these fine grains is preferably in the range of from about 0.15 to about 0.5 micrometers and, more preferably in the range of from about 0.15 to about 0.30 micrometers.

In a specific embodiment of the invention, up to 15 mole percent, and preferably between 1 and 10 mole percent, relative to the total quantity of silver halides, of non-sensitized silver halide emulsion with fine grains are added in step (ii)of the method.

It is important to note that the fine unsensitized grains are added before the chemical and spectral sensitization.

According to step (iii) of the method according to the invention, the silver halide tabular grain emulsions are sensitized:

Chemically according to the methods described in Section IV of *Research Disclosure*. The chemical sensitizers generally used are compounds of sulfur and(or) selenium and gold. Sensitization by reduction can also be used.

Spectrally according to the methods described in section V of *Research Disclosure*. The sensitizing dyes can be added before, during or after the chemical sensitization.

The silver halide tabular grain emulsions can be spectrally sensitized with dyes of various classes, including dyes of the polymethine class, which includes cyanines, merocyanines, complex cyanines and merocyanines (i.e., tri-, tetra-, and polynuclear cyanines and merocyanines), oxonols, hemioxonols, styryls, merostyryls and streptocyanines. The representative spectral dyes are described in Section V of *Research Disclosure*.

The emulsion freshly prepared can be coated as a layer on a conventional support, or chilled and stored for later use. The suitable supports are supports of cellulose acetate, polyester, polycarbonate, resin coated paper, etc. The methods used to obtain the layers are known, and include in particular extrusion, hopper, and curtain coating. The coating additives are also known and described in Section IX.A of *Research Disclosure*.

The tabular grain emulsions prepared according to the invention can be used in any type of photographic material, in negative or reversal, with known types of chemical and spectral sensitization. This invention is illustrated by the examples below.

EXAMPLE 1

Preparation of an emulsion (A) with thin tabular grains of the AgBrI type:

In a reactor were placed 24 l of water, 0.6 g/l of gelatin, 130.4 g of a 4N solution of nitric acid, and 0.88 g/l of sodium bromide. The pAg of this solution was 9.5 and the pH 1.78. 0.2 ml/l of Pluronic™-31R1 detergent was then added. The temperature was increased to 47° C., and over a period of 1 minute were simultaneously added 80 ml of an aqueous solution containing 0.0224 mole of silver nitrate, and 79.6 ml of an aqueous solution containing 0.0248 mole of sodium bromide. After mixing for 2 minutes, 392 ml of an aqueous solution of 40.38 g of sodium bromide was added. While the temperature of the mixture was increased to 62° C. for 10 minutes, 400 ml of aqueous ammonia was added (containing 0.15 g/l of ammonium sulfate and 230 g of a solution of 2.5N sodium hydroxide), with mixing for 9 minutes. Over a period of 4 minutes, 5,299 ml of an aqueous solution of gelatin (containing 100 g/l of oxidized gelatin and 26 ml of a 4N solution of nitric acid)was added to the mixture. Over a period of 20 minutes, at a constant flow rate, was added 1,200 ml of an aqueous solution of silver nitrate (0.28 mole/l) and 1,282 ml of an aqueous solution of sodium bromide (0.312 mole/l). Ten minutes after the end of the addition, were added 13,013 ml of an aqueous solution of silver nitrate (2.5 mole/l) and 13,013 ml of an aqueous solution of sodium bromide (2.433 mole/l) with a flow rate profile in the form of a linear ramp starting at 32.4 ml/minute and 250.8 ml/minute respectively and lasting 91.9 minutes. Then 2,000 ml of an aqueous solution of gelatin (containing 381.359 g of de-ionized gelatin) was added over a period of 10 minutes. 4,221 ml of an aqueous solution of KI and NaBr (containing 0.2 mole/l of KI and 0.3 mole/l of NaBr) was then added to the mixture over a period of 17.5 minutes.

1,350 ml of an aqueous solution of silver nitrate (2.5 mole/l) was then added to the mixture with a constant flow rate over a period of 10 minutes to bring the pAg to 8.74.

4,455 ml of an aqueous solution of silver nitrate (2.5 mole/l) and 45,514.4 ml of an aqueous solution of NaBr (2.4777 mole/l) and 0.0222 mole/l of KI were then added with a constant flow rate over a period of 33 minutes.

During this operation and after 18.95 minutes, 81.24 ml (0.1896 mmole) of a solution of potassium hexachloroiridate were added to the mixture.

The silver halide emulsion thus obtained was washed. The properties of the grains of this emulsion are listed below.
ECD: 3.89 microns.
Average thickness: 0.118 microns.
Mean projected area of the tabular grains: 100%.
Mean aspect ratio of grains: 33.
COV: 17.5%.

EXAMPLE 2

Preparation of an AgBr emulsion (B) with fine cubic grains (i.e., grains comprising six {100} crystal faces).

In a reactor were placed 7.5 l of a solution containing 37.7 g/l of gelatin, 2 g of 1,8-dihydroxy-3,6-dithiaoctane, NaBr to obtain a pBr of 2.0, and $HNO_3$ to obtain a pH of 2.9. To the mixture, with stirring, were added:

A solution of silver nitrate (2.4762 M) and a halide solution containing 2 mole percent of NaBr and KI, with a flow rate of 102 ml/minute for the silver and the halides over a period of 3 minutes.

A solution of silver nitrate (2.4762 M) with a flow rate of 102 ml/minute over a period of 3 minutes.

A solution of silver nitrate (2.4762 M) and 2.45 M of a halide solution containing 2 mole percent of NaBr and KI with a flow rate of 102 ml/minute for each, over a period of 30 minutes.

During the precipitation, the pBr was maintained at 3.80 and the temperature at 40° C. At the end of the precipitation the pBr and the pH were 3.8 and 4.5 respectively. For the resulting cubic grains, the average length of the edge of the main face is less than 200 nmn.

EXAMPLE 3

Preparation of an AgBrI emulsion (C) with fine octahedral grains (i.e., grains comprising eight {111} crystal faces).

In a reactor were placed 7.5 l of a solution containing 37.7 g/l of gelatin, 2 g of 1,8-dihydroxy-3,6-dithiaoctane, NaBr to obtain a pBr of 2.0 and $HNO_3$ to obtain a pH of 2.9. To the mixture, with stirring, were added:

A solution of silver nitrate (2.4762 M) and a halide solution containing 2 mole percent of NaBr and KI, with a flow rate of 102 ml/minute for the silver and the halides over a period of 3 minutes.

A solution of silver nitrate (2.4762 M) with a flow rate of 102 ml/minute over a period of 3 minutes.

A solution of silver nitrate (2.4762 M) and 2.45 M of a solution of halides containing 2 mole percent of NaBr and KI with a flow rate of 102 ml/minute for each, over a period of 30 minutes.

During the precipitation, the pBr was maintained in the range of from 2 to 2.25, and the temperature at 40° C. At the end of the precipitation, the pBr and the pH were 2.25 and 4.5 respectively. For the resulting octahedral grains, the average length of the edge of the main face was less than 200 nm.

EXAMPLE 4 (Invention)

Operating procedure for the addition of the fine cubic emulsion and the chemical and spectral sensitization.

In a reactor, with stirring, was added 0.1 mole of the emulsion with tabular grains prepared in example 1. This emulsion was melted at 40° C., and 2 molar percent (relative to the tabular grain emulsion) of the small cubic grain emulsion prepared in example 3 was added. When the emulsion became homogeneous, a solution of sodium thiocyanate (100 mg/mole of silver) was added. After a delay of 5 minutes, 45 mg/mole of compound (A), 3-[3-[(methylsulfonyl)amino]-3-oxopropyl]-benzothiazolium tetrafluoroborate, was added. After a delay of 5 minutes, were added 328 mg/mole of silver of dye 1 dispersed in gelatin, and the mixture stirred for 15 minutes. 158 mg/mole of silver of dye 2 dispersed in gelatin was then added, and the mixture kept stirred for 15 minutes.

Compound (B), 1-(3-acetamidophenyl)-5-mercaptotetrazole (5 mg/mole of silver) was then added, and the mixture left for 5 minutes. 1.944 mg/mole of sensitizer (C), [N-(dimethylamino)thioxomethyl)-N-methylglycine sodium salt] and 1.491 mg/mole of silver of gold sensitizer (D), [bis(1,4,5-trimethyl-1,2,4-triazolium-3-thiolate)gold complex tetrafluoroborate].

The reaction mixture was then heated at 1.5° C. per minute and maintained at 55° C. for 15 minutes. The reaction mixture was then cooled to 40° C. at 1.5° C. per minute.

1.75 g/mole of compound (E), sodium [1,2,4]triazolo[1,5a]pyrimidin-7-ol, was then added. After a delay of 5 minutes, 5.278 g/mole of compound (F), disodium 4,5-dihydroxybenzene-1,3-disulfonate, was added. After a delay of 5 minutes, 28 g of gelatin and 308 g of distilled water were added.

After chemical and spectral sensitization the emulsion was coated on a cellulose triacetate support, with a titer of 0.807 $g/m_2$ of silver. This coat of emulsion was covered with a gelatin overcoat (2.42 $g/m^2$) containing a tanning agent. The photographic samples were exposed for 1/50 second using an X20 sensitometer equipped with a lamp with a color temperature of 3,000°K. The sensitometer was equipped with the following filters: a "5A Daylight filter", "Inconel" filters, and a "Wratten 2B filter".

The samples were exposed through a density scale comprising 21 graduations incremented in 0.15 Log E steps.

The samples were then processed using a standard Ektachrome E6 process comprising the following steps:

Black-and-white development in the presence of a silver halide solvent.

Washing.

Inversion bath.

Color development (38° C.)

Washing

Bleaching

Fixing

Washing.

Stabilization

Speed was measured for each photographic sample. Speeds were calculated relative to the emulsion to which fine cubic grains bad not been added, which was assigned a value of 100.

The percentage fogging was calculated as follows:

(Minimum density (fog)/maximum density)×100

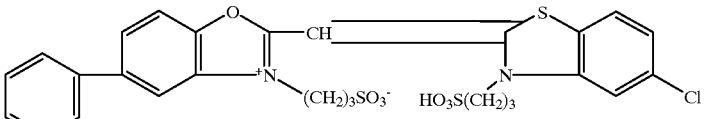

Dye 2

•$Net_3$

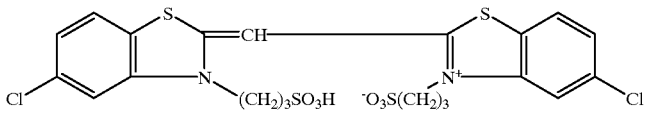

Dye 2

•$Net_3$

The percentage of fine cubic grains (prepared in example 2) was then varied. The resulting emulsions were chemically and spectrally sensitized according to the operating procedure described above.

The effect of adding fine cubic grains was tested:

(a) before chemical and spectral sensitization, and (b) before raising the temperature to 55° C.

The speed and fogging were measured in the different cases.

These two operations were repeated for an addition of fine octahedral grains prepared in example 3. The results are given in Tables I and II

TABLE 1

Addition of fine cubic grains

| EMULSION | | Test 1 Control | Test 2 example 4 | Test 3 | Test 4 | Test 5 | Test 6 | Test 7 |
|---|---|---|---|---|---|---|---|---|
| Addition of fine cubic grains before sensitization | % | — | 2 | 4 | 8 | — | — | — |
| NaSCN | mg/mol | 100 | 100 | 100 | 100 | 100 | 100 | 100 |
| Compound (A) | mg/mol | 45 | 45 | 45 | 45 | 45 | 45 | 45 |
| Dye 1 | mg/mol | 328 | 328 | 328 | 328 | 328 | 328 | 328 |
| Dye 2 | mg/mol | 158 | 158 | 158 | 158 | 158 | 158 | 158 |
| Compound (B) | mg/mol | 5 | 5 | 5 | 5 | 5 | 5 | 5 |
| Sensitizer (C) | mg/mol | 1.944 | 1.944 | 1.944 | 1.944 | 1.944 | 1.944 | 1.944 |
| Sensitizer (D) | mg/mol | 1.491 | 1.491 | 1.491 | 1.491 | 1.491 | 1.491 | 1.491 |
| Addition of fine cubic grains before temperature shelf | % | — | — | — | — | 2 | 4 | 8 |
| Temperature | ° C. | 55 | 55 | 55 | 55 | 55 | 55 | 55 |
| Duration | minute | 15 | 15 | 15 | 15 | 15 | 15 | 15 |
| Compound (E) | mg/mol | 1750 | 1750 | 1750 | 1750 | 1750 | 1750 | 1750 |
| Compound (F) | mg/mol | 5278 | 5278 | 5278 | 5278 | 5278 | 5278 | 5278 |
| Speed | | 100 | 103 | 107 | 108 | 99 | 100 | 101 |
| Fogging | % | 46.7 | 33.1 | 25.1 | 16.0 | 43.7 | 40.9 | 41.6 |

TABLE 2

Addition of fine octahedral grains

| EMULSION | | Test 1 Control | Test 8 | Test 9 | Test 10 | Test 11 | Test 12 | Test 13 |
|---|---|---|---|---|---|---|---|---|
| Addition of fine octahedral grains before sensitization | % | — | 2 | 4 | 8 | — | — | — |
| NaSCN | mg/mol | 100 | 150 | 200 | 250 | 300 | 300 | 300 |
| Compound (A) | mg/mol | 45 | 45 | 45 | 45 | 45 | 45 | 45 |
| Dye 1 | mg/mol | 328 | 328 | 328 | 328 | 328 | 328 | 328 |
| Dye 2 | mg/mol | 158 | 158 | 158 | 158 | 158 | 158 | 158 |
| Compound (B) | mg/mol | 5 | 5 | 5 | 5 | 5 | 5 | 5 |
| Sensitizer (C) | mg/mol | 1.944 | 1.944 | 1.944 | 1.944 | 1.944 | 1.944 | 1.944 |
| Sensitizer (D) | mg/mol | 1.491 | 1.491 | 1.491 | 1491 | 1.491 | 1.491 | 1.491 |
| Addition of fine octahedral grains before temperature shelf | % | — | — | — | — | 2 | 4 | 8 |
| Temperature | ° C. | 55 | 55 | 55 | 55 | 55 | 55 | 55 |
| Duration | minute | 15 | 15 | 15 | 15 | 15 | 15 | 15 |
| Compound (E) | mg/mol | 1750 | 1750 | 1750 | 1750 | 1750 | 1750 | 1750 |
| Compound (F) | mg/mol | 5278 | 5278 | 5278 | 5278 | 5278 | 5278 | 5278 |

TABLE 2-continued

| | | Addition of fine octahedral grains | | | | | | |
|---|---|---|---|---|---|---|---|---|
| EMULSION | | Test 1 Control | Test 8 | Test 9 | Test 10 | Test 11 | Test 12 | Test 13 |
| Speed | | 100 | 88 | 70 | 45 | 88 | 78 | 74 |
| Fogging | % | 46.7 | 19.6 | 12.4 | 5.7 | 24.8 | 22.6 | 13.4 |

Figure 2:
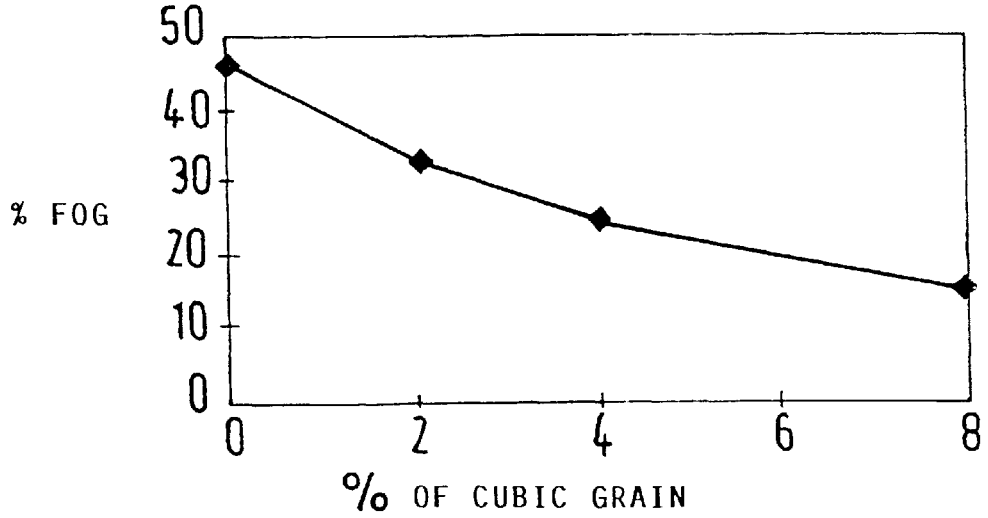
FIG. 2 is a plot of the percent of fogging versus the percentage of added non-sensitized silver halide made up of fine cubic grains.

As can be seen from Tables I and II, and FIGS. 1 and 2, addition of fine cubic grains comprising {100} crystal faces before chemical and spectral sensitization (Tests 2 to 4) not only improved the speed of the emulsions relative to the control emulsion (test 1), but also reduced fogging. If this addition was made before the temperature shelf at 55° C. (Tests 5 to 7), this unexpected effect was markedly attenuated, and no gain in speed nor any reduction of fogging was observed.

As shown by the addition of fine octahedral grains (i.e., grains comprising only {111} crystal faces in Tests 8 to 13, the unexpected effect on speed and fogging (improved speed and reduced fogging) is specific to the addition of fine grains comprising {100} crystal faces before the chemical and spectral sensitization. It is to be noted that the addition of fine cubic grains had no detrimental effect on granularity.

The invention has been described in detail with particular reference to certain preferred embodiments thereof, but it will be understood that variations and modifications can be effected within the spirit and scope of the invention.

What is claimed is:

1. A method of preparing a silver halide tabular grain emulsion comprising (a) providing an emulsion in which silver halide tabular grains containing greater than 50 mole percent bromide, based on silver, account for greater than 50 percent of total grain projected area, (b) adding to the emulsion of step (a) a non-sensitized emulsion containing silver halide grains which (i) contain greater than 80 mole percent bromide, based on silver, (ii) exhibit {100} crystal faces, and (iii) exhibit a mean grain edge length of less than about 0.5 micrometers, and (c) chemically sensitizing the emulsion resulting from step (b).

2. The method of claim 1, wherein the non-sensitized silver halide grains added in step (b) contains up to 20 mole percent iodide.

3. The method of claim 1, wherein the emulsion precipitated in step (a) contains at least 80 mole percent bromide, based on silver.

4. The method of claim 1, wherein the emulsion precipitated in step (a) contains at least 90 mole percent bromide, based on silver.

5. The method of claim 1, wherein the non-sensitized silver halide grains added in step (b) contains greater than 90 mole percent bromide based on silver.

6. The method of claim 1 wherein up to 15 molar percent of non-sensitized silver halide grains, based on total silver halide, has been added in step (b).

7. The method of claim 1, wherein the tabular grains have an equivalent circular diameter in the range of from 0.8 to 10 micrometers, for greater than 70% of the total projected area of the grains.

8. The method of claim 1, wherein the emulsion is chemically sensitized with sulfur and gold in step (c).

9. The method of claim 1, wherein the emulsion is sensitized chemically and spectrally in step (c).

10. The method of claim 1, wherein the non-sensitized emulsion added in step (b) exhibit a mean grain edge length in the range of from about 0.15 to about 0.5 micrometers.

11. The method of claim 1, wherein the non-sensitized emulsion added in step (b) exhibit a mean grain edge length in the range of from about 0.15 to about 0.3 micrometers.

12. A radiation-sensitive tabular grain silver halide emulsion prepared by the method of claim 1.

* * * * *